US009783985B2

(12) United States Patent
Iverson

(10) Patent No.: US 9,783,985 B2
(45) **Date of Patent: *Oct. 10, 2017**

(54) THERMAL BREAK WOOD STUD WITH RIGID INSULATION WITH NON-METAL FASTENERS AND WALL FRAMING SYSTEM

(71) Applicant: Roosevelt Energy, LLC, Ham Lake, MN (US)

(72) Inventor: Brian Iverson, Ham Lake, MN (US)

(73) Assignee: Roosevelt Energy, LLC, Ham Lake, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/596,521

(22) Filed: May 16, 2017

(65) Prior Publication Data

US 2017/0247883 A1 Aug. 31, 2017

Related U.S. Application Data

(63) Continuation-in-part of application No. 14/796,571, filed on Jul. 10, 2015, now Pat. No. 9,677,264.

(51) Int. Cl.
*E04B 1/30* (2006.01)
*E04B 1/76* (2006.01)
(Continued)

(52) U.S. Cl.
CPC ..... *E04C 3/122* (2013.01); *E04B 1/78* (2013.01); *E04B 2/70* (2013.01); *E04B 2103/04* (2013.01)

(58) Field of Classification Search
CPC ..... E04B 1/30; E04B 1/76; E04B 2/70; E04B 2001/7679; E04C 3/29
See application file for complete search history.

(56) References Cited

U.S. PATENT DOCUMENTS 4,224,774 A * 9/1980 Petersen ..... E04B 2/707 52/309.14
4,578,909 A * 4/1986 Henley ..... E04B 1/74 52/210

(Continued)

FOREIGN PATENT DOCUMENTS

CA WO 2014197972 A1 * 12/2014 ..... E04C 3/29
EP 1705305 9/2006
WO WO 2017011121 A1 * 1/2017 ..... E04B 1/30

OTHER PUBLICATIONS

Betzwood Associated PC, "5 Proven Ways to Optimize Framing," http://www.betzwood.com/2012/08/09/optimize-framing/, pp. 1-7 (2012).

(Continued)

*Primary Examiner* — Rodney Mintz
(74) *Attorney, Agent, or Firm* — Briggs and Morgan, P.A.; Gerald E. Helget

(57) ABSTRACT

A thermal break wood and rigid insulation stud is comprised of two non-dimensional lumber sections with a thermal break section of rigid foam insulation therebetween. A non-metallic truss arrangement of mechanical fasteners holds the lumber and insulation sections secured together greatly improving the strength of the thermal break wood and rigid insulation stud. The studs in a wall are 24" on center. The studs are used for headers and sills and also may be used for top and bottom plates. The corners have an exterior all wood stud, an interior all wood stud and an interior all wood stud adjacent to the interior wood stud completing the interior corner for nailing gypsum board thereto. This corner has a thermal break space between the exterior and interior wood studs for insulation placement. The corners may also have two 3×6 thermal studs oriented 90 degrees from each other and an interior all wood stud for completing the interior corner for nailing gypsum board (Continued)

thereto. This corner arrangement also has a thermal break through its construction.

23 Claims, 11 Drawing Sheets

(51) Int. Cl.

| | |
|---|---|
| ***E04C 3/29*** | (2006.01) |
| ***E04B 2/70*** | (2006.01) |
| ***E04C 3/12*** | (2006.01) |
| ***E04B 1/78*** | (2006.01) |

(56) References Cited

U.S. PATENT DOCUMENTS 4,578,914 A * 4/1986 Staples ..... E04B 1/04 52/220.2
4,671,032 A * 6/1987 Reynolds ..... E04C 2/386 52/127.11
4,720,948 A * 1/1988 Henley ..... E04B 1/74 52/404.3
4,852,310 A * 8/1989 Henley ..... E04B 1/74 52/404.3
4,852,322 A * 8/1989 McDermid ..... E04C 3/29 52/404.3
4,937,122 A * 6/1990 Talbert ..... B32B 3/22 428/120
5,209,036 A * 5/1993 Cancilliari ..... E04B 1/2604 52/309.4
5,505,031 A * 4/1996 Heydon ..... B26D 3/006 52/241
5,609,006 A * 3/1997 Boyer ..... E04B 2/7457 52/309.7
5,720,144 A * 2/1998 Knudson ..... E04C 3/07 29/416
6,125,608 A * 10/2000 Charlson ..... E04B 1/7604 52/404.1
6,145,257 A * 11/2000 Cappuccio ..... E04B 2/8647 52/220.2
6,412,249 B1 * 7/2002 Boyer ..... E04B 2/7457 52/481.1
7,574,837 B2 * 8/2009 Hagen, Jr. ..... B29C 44/186 52/309.7
7,743,578 B2 * 6/2010 Edmondson ..... E04B 1/24 52/653.1
7,866,112 B2 * 1/2011 Edmondson ..... E04B 1/24 52/633
8,424,266 B2 * 4/2013 Edmondson ..... E04B 2/7412 52/650.1
8,516,778 B1 * 8/2013 Wilkens ..... E04C 3/292 52/309.13
9,103,113 B2 * 8/2015 Lockhart ..... E04B 2/7412
9,593,486 B2 * 3/2017 Thompson ..... E04C 3/122
9,677,264 B2 * 6/2017 Iverson ..... E04B 1/30
2004/0003550 A1 * 1/2004 Konopka ..... E04B 1/74 52/169.6
2004/0003567 A1 * 1/2004 Konopka ..... E04B 1/74 52/561
2005/0050847 A1 * 3/2005 Lott ..... E04C 2/246 52/782.1
2005/0183367 A1 * 8/2005 Lembo ..... E04B 1/7662 52/404.1
2005/0183382 A1 * 8/2005 Jensen ..... B29C 65/5042 52/741.3
2006/0236652 A1 * 10/2006 Kismarton ..... B29C 65/564 52/782.1
2006/0254197 A1 * 11/2006 Tiberi ..... E04B 2/707 52/834
2007/0130866 A1 * 6/2007 Lott ..... E04C 2/246 52/481.1
2007/0227095 A1 * 10/2007 Hubbe ..... E04B 2/707 52/653.1
2007/0283661 A1 * 12/2007 Daniels ..... E04C 3/36 52/841
2010/0037542 A1 * 2/2010 Tiberi ..... E04B 2/707 52/204.2
2010/0236172 A1 * 9/2010 Wirth ..... E04B 1/26 52/309.4
2011/0107693 A1 * 5/2011 Haskell ..... E04B 1/26 52/204.2
2011/0239573 A1 * 10/2011 Lockhart ..... E04B 2/7412 52/404.1
2012/0011793 A1 * 1/2012 Clark ..... E04C 3/122 52/309.4
2012/0174511 A1 * 7/2012 Harding ..... B66F 9/142 52/302.1
2016/0289968 A1 * 10/2016 De Waal ..... E04C 3/29
2016/0356044 A1 * 12/2016 Thompson ..... E04C 3/122
2017/0009442 A1 * 1/2017 Iverson ..... E04B 1/30
2017/0167138 A1 * 6/2017 Thompson ..... E04C 3/29

OTHER PUBLICATIONS

International Search Report and Written Opinion of PCT/US2016/037357, dated Sep. 8, 2016.

* cited by examiner

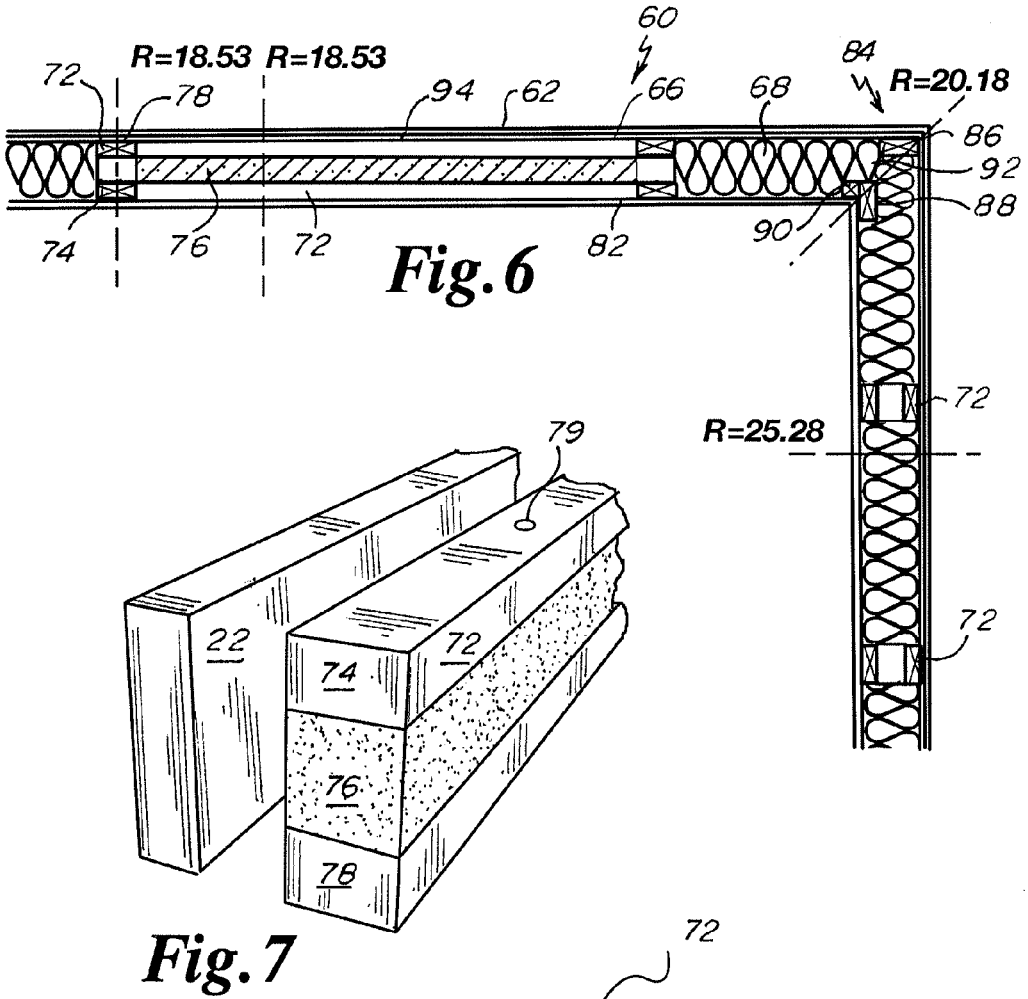
Fig. 6
Fig. 7
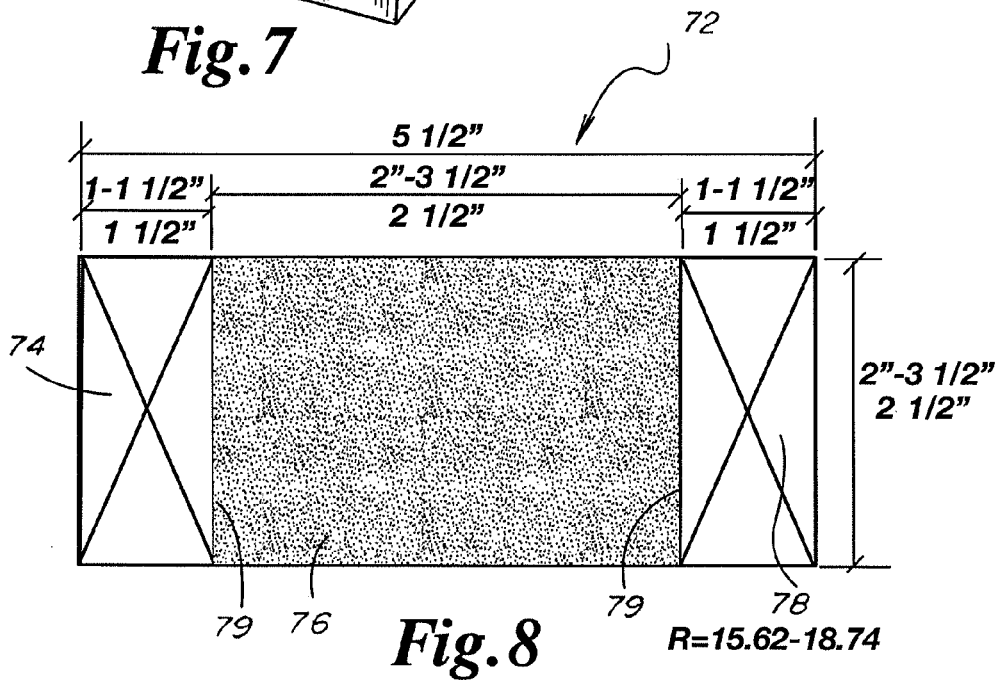
Fig. 8

THERMAL BREAK WOOD STUD WITH RIGID INSULATION WITH NON-METAL FASTENERS AND WALL FRAMING SYSTEM

This application is a Continuation-in-Part and claims priority from parent application Ser. No. 14/796,571, filed on Jul. 10, 2015.

BACKGROUND OF THE INVENTION

The present invention relates to wood framing systems for residential and light commercial buildings. More specifically, the present invention is concerned with a framing system and component designs with built-in thermal breaks throughout the entire external walls, and in some instances, interior walls and/or interior party or common walls in multi-tenant structures.

Standard construction today uses either 2×4 or 2×6 solid lumber generally spaced 16" on center. Where energy conservation is a concern, most builders frame an exterior wall with 2×6's. Up to 30 percent of the exterior wall (studs, top and bottom plates, cripple studs, window/door jams and headers) is solid wood framing. Thermal bridges are points in the wall that allow heat and cold conduction to occur. Heat and cold follow the path of least resistance—through thermals bridges of solid wood across a temperature differential wherein the heat or cold is not interrupted by thermal insulation. The more volume of solid wood in a wall also reduces available insulation space, and further, the thermal efficiency of the wall suffers and the R value (resistance to conductive heat flow) decreases.

The most common way to minimize thermal bridging is to wrap the entire exterior of the building in rigid insulation to minimize heat loss and cold from entering the building. This effort significantly increases materials, carbon footprint and labor costs and can be undesirable in increasing the thickness of the building walls with non-structural materials.

Attempts have been made to construct framing systems with built in thermal breaks with the use of dimensional lumber (2×4, 2×6, 2×8, 2×10 and 2×12). Such efforts require extensive labor and materials costs and have not resulted in effective thermal breaks throughout the whole wall, corners and building envelope structure.

There is a need to design a framing system with complete thermal breaks throughout the walls, corners and building structure made of non-dimensional lumber with rigid insulation that has increased strength, more surface area for building materials to be fastened to, uses less lumber, has more space for insulation to greatly increase thermal efficiencies.

To understand benefits of the present invention, one must have an understanding of the standard or conventional wood framed building. A 960 square feet building 10 is used here illustratively.

Referring to prior art FIGS. 1 through 5, the top sectional plan view and wall constructions of the standard 960 square feet building 10 maybe understood. The actual face of a piece of dimensional lumber (2×4, 2×6, 2×8, 2×10 and 2×12) is actually only 1⅜" because the edges are rounded to minimize splintering of the wood for the sake of the carpenter to avoid slivers.

Sectionally from the exterior surface to the interior surface typically are located siding 12, exterior air film 14, oriented strand board (OSB) plywood sheathing, fiberglass batt insulation 16 (or blown-in or sprayed-in insulation), 2×6 wall studs 22 16" on center, interior air film 24 and gypsum board 26. Headers 30 typically comprises two 2×6 with rigid foam insulation 31.

From the plan view (FIG. 1) the standard building R values: through the 2×6 studs 22 is 9.16; through the header 30 with foam insulation 31 is 15.285; average through the pocket corner 48 is 11.63; and through the insulated wall portion is 21.28. This standard building requires 109 2×6 vertically oriented 2×6 studs to be compared later to the thermal break or Tstud design and framing system of the present invention.

Prior art FIGS. 2 through 5 show the top plan view of the prior art standard 960 square feet building, the vertical wall construction of window back wall 38, the vertical wall construction of door front wall 40 and the vertical wall construction of side walls 42. The walls begin with 2×6 top and bottom plates 35 and 36, 2×6 wall studs, headers 30, window sills 32 and cripple studs 34 for adjacent windows 44, door 46, lower sills 32 and above headers 30. This standard building construction has 109 stud thermal bridges.

The standard pocket corner 48 is clearly depicted in FIG. 1 and is constructed of three 2×6's studs 50 built in a U shaped plus one side 2×6 stud 52. Insulation 54 is typically filled into its cavity.

SUMMARY OF THE INVENTION

A thermal break wood and rigid insulation stud is comprised of two non-dimensional lumber sections with a thermal break section of rigid foam insulation therebetween. A non-metallic truss arrangement of mechanical fasteners holds the lumber and insulation sections secured together greatly improving the strength of the thermal break wood and rigid insulation stud. The studs in a wall are 24" on center. The studs are used for headers and sills and also may be used for top and bottom plates. The corners have an exterior all wood stud, an interior all wood stud and an interior all wood stud adjacent to the interior wood stud completing the interior corner for nailing gypsum board thereto. This corner has a thermal break space between the exterior and interior wood studs for insulation placement. The corners may also have two 3×6 thermal studs oriented 90 degrees from each other and an interior all wood stud for completing the interior corner for nailing gypsum board thereto. This corner arrangement also has a thermal break through its construction.

A principal object and advantage of the present invention is that the percentage increase in wall construction energy efficiency is approximately 18 to 39% depending on the current energy code within each municipality.

Another principal object and advantage of the present invention is that, according to the US Home Builders Association or www.census.gov, the median home built in America (in 2016) is actually 2456 square feet in size and the present invention would save a minimum of 51 to 110 vertical studs over the standard construction. There are approximately 1,170,000 of these median homes built per year (2016 US Housing Starts).

Another principal object and advantage of the present invention is that using the International Log Rule on board feet per 16' section of a tree that is 22" in diameter and 3 sections per tree equates into a savings of 493,000 trees not being cut down in a single year to build the approximately 1,170,000 median homes in a single year.

Another principal object and advantage of the present invention is that the invention has a smaller carbon footprint than standard building construction simply by use of less materials and labor costs.

Another principal object and advantage of the present invention is that the 3×6 thermal break stud has more surface area to affix the sheathing, air film, drywall and interior trim to the thermal studs.

Another principal object and advantage of the present invention is that it improves sound transmission loss through an interior or exterior wall with a rating system called Sound Transmission Class (STC) improving from a standard wall rating of about 36 to a rating of about 43 for walls built with the thermal break studs of the present invention by breaking the vibration paths by decoupling the interior walls when using the thermal break studs versus standard studs.

Another principal object and advantage of the present invention is that it is 2½" wide and the actual face of the present invention is rounded similar to dimensional lumber to where the actual face is 2⅜", or a whole one inch wider than dimensional lumber.

Another principal object and advantage of the present invention is that the total face surface area to attach drywall or exterior sheathing to on our 960 square foot building model is 14,414 square inches—an increase of 11.86% of face area; and yet the present system uses up to 46 less vertical "studs" in its walls compared to standard total face surface area of 12,886 square inches. This amounts to saving in material costs and manpower in framing, sheathing, dry walling, drywall finishing and trim applications.

Another principal object and advantage of the present invention is that because the thermal break stud is significantly wider by 1", the butting up of two pieces of sheathing or drywall adjoined to a single thermal break stud with 80% more area, the sheathing or drywall is more rigid than anticipated.

Another principal object and advantage of the present invention is that there is more insulation in the wall cavity with less solid wood to increase thermal efficiency.

Another principal object and advantage of the present invention is that the cost to apply 1" R 5 rigid insulation to the entire outside perimeter of the building is by far more that the costs to build with the Tstud and it accomplishes the same or better insulation qualities for one fourth of the price thus giving the Tstud a return on investment.

Another principal object and advantage of the present invention is that the present invention does not absolutely require cripple studs and the Tstud may also be used for top and bottom plates, headers and sills.

Another principal object and advantage of the present invention is that a single 3×6 Tstud has enough integral strength that it may be used as a header for up to 4' 3" spans and two (or three) Tstuds may be used for headers up to 8' 6" in width with only back nailing through the Tstuds—all without the use of cripple studs.

Another principal object and advantage of the present invention is that the windows and doors have a thermal break all around the window and door openings thus improving the thermal effectiveness of the window and door jams.

Another principal object and advantage of the present invention is that there could be a reduction in the needed and required sizing for furnaces and air conditioning equipment.

Another principal object and advantage of the present invention is that the Tstud design and framing system requires less carpenter time to rough-in a building simply because the vertical Tsuds are 24" on center and not 16" on center for the standard building. However, the present invention maybe built with Thermal break studs 16" on center even though not required.

Another principal object and advantage of the present invention is that the Tstud design and framing system offers greater insulation efficiencies and nailing surfaces without requiring the building walls to be deeper than 6", especially when rigid insulation added to the entire outside perimeter of the adding to the total 6" wall depth.

Another principal object and advantage of the present invention is that all these objects and advantages are accomplished without losing any integrity in building performance or structural qualities.

Another principal object and advantage of the present invention is that there will be a reduction on the future utility grid and a reduction on the future carbon footprint required to produce the electricity and gas to heat and cool a home built to according to this invention.

Another principal object and advantage of the present invention is the fire rating of the thermal break section of rigid insulation, that also covers substantial portions of the Tstud. In preliminary test results by an independent agency, the Tstuds tested in a standard testing apparatus to be a minimum of twice as beneficial to saving structures by having a Class A fire rating versus typical construction 2× wood members of having a Class C fire rating, thus potentially saving lives and allowing fire personnel to enter a burning structure more often and allowing additional time for occupants to vacate a burning structure.

BRIEF DESCRIPTION OF THE DRAWINGS

FIG. 6 is a top plan view of a wall and corner segment of the present invention;

FIG. 7 is a perspective view of a standard dimensional 2×6 stud along side of the 3×6 thermal stud (hereinafter "Tstud") of the present invention;

FIG. 8 is a dimensional view of the 3×6 Tstud of the present invention;

DETAILED SPECIFICATION

Figure 1:
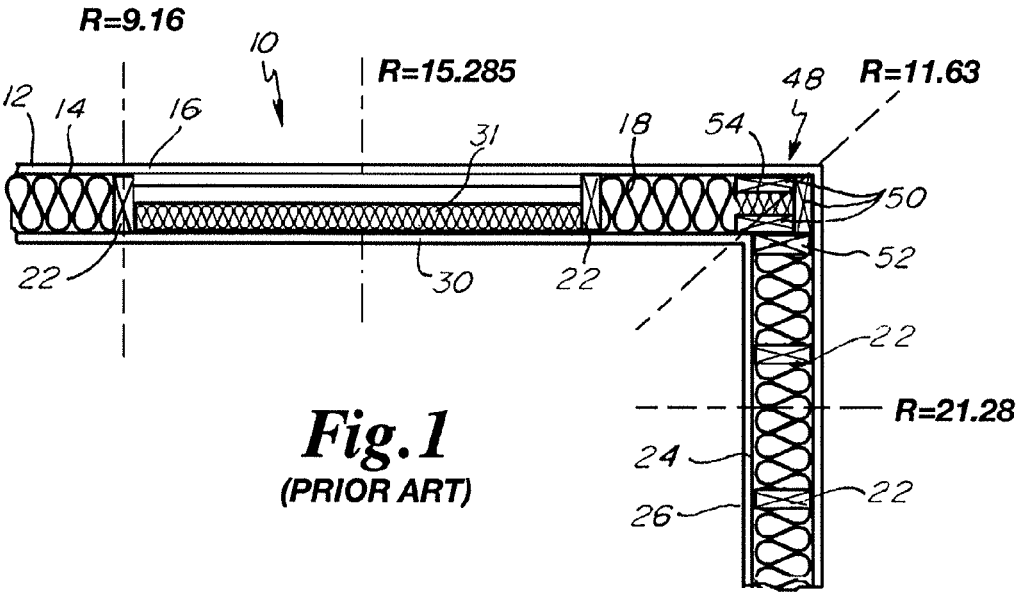
Fig.1 (PRIOR ART)
FIG. 1 is a prior art top plan view of a wall and corner segment of conventional or standard construction showing R values through various portions of the walls.
Figure 2:
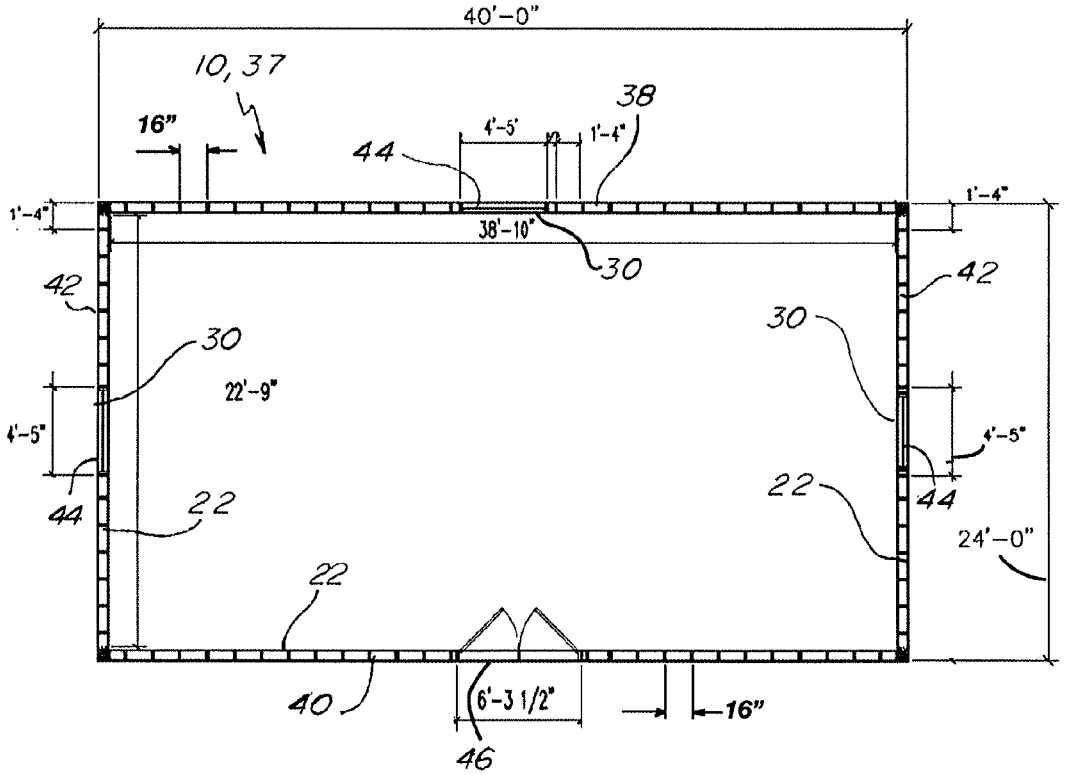
Fig.2 (PRIOR ART)
FIG. 2 is a prior art plan view of a standard 960 square feet building.
Figure 3:
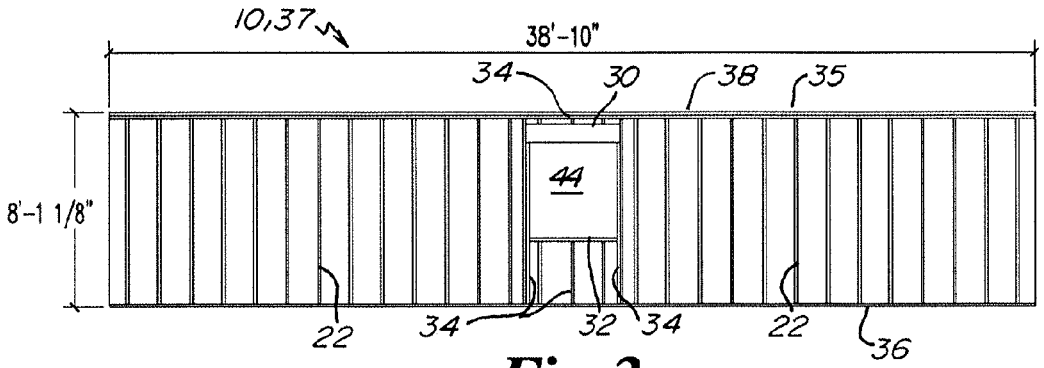
Fig.3 (PRIOR ART)
FIG. 3 is a prior art standard rear wall elevational view of the building of FIG. 2.
Figure 4:
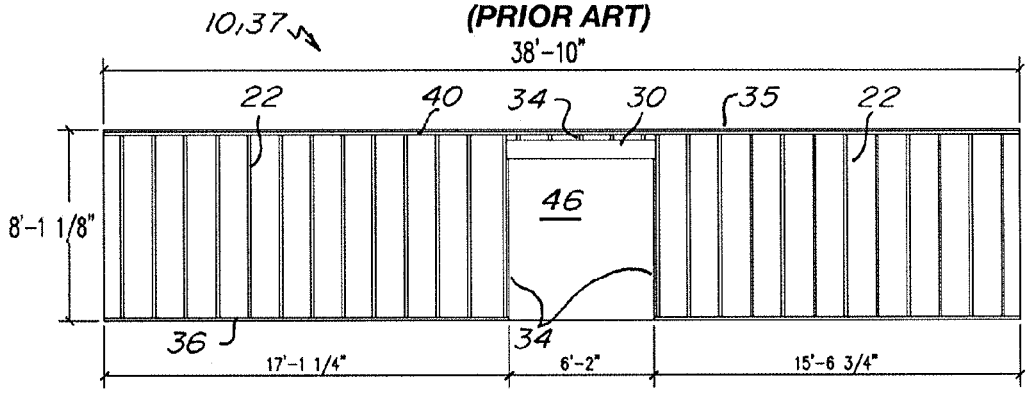
Fig.4 (PRIOR ART)
FIG. 4 is a prior art standard front wall elevational view of the building of FIG. 2.
Figure 5:
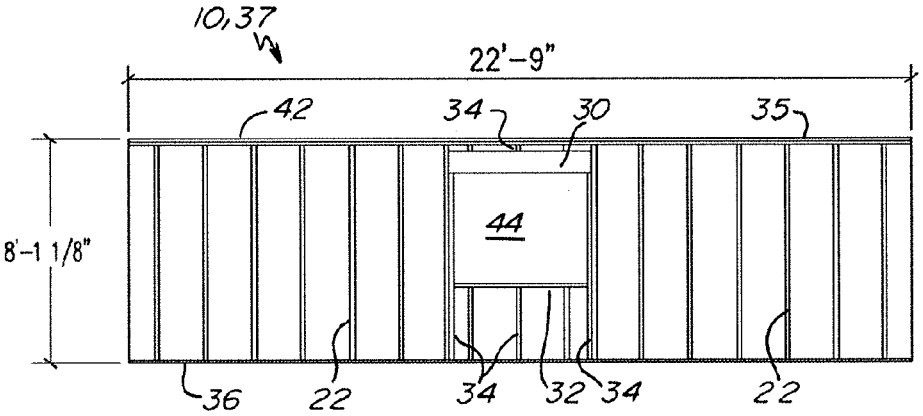
Fig.5 (PRIOR ART)
FIG. 5 is a prior art standard left side elevational view of the building of FIG. 2, the right side being a mirror image of the left side.

Referring to FIGS. 6 through 11, the thermals break Tstud design and wall system 60 of the present invention may be viewed, understood and compared with the standard stud wall system of FIGS. 1 through 5.

Sectionally from the outside to inside of the Tstud wall building is firstly siding 62 on the outside of the building 60. Next there is OSB plywood sheathing 66 which is nailed to the thermals break 3×6 Tstud 72 which has more nailing and/or gluing surface area than a dimensional 2×6 stud 22. That is, the Tstud 72 nailing surface is 3" compared to 2" of the standard 2×6 stud 22 which makes the carpenter's job of putting up the sheathing 66 more easy with correct nail locations. Next follows fiberglass batt insulation 68. In some cases, blown-in or sprayed-in insulation may be used. Illustratively, the R value efficiency calculations for the fiberglass batt insulation are based on Owens Corning (Toledo, Ohio) fiberglass insulation. Other fiberglass insulation manufacturers may have higher or lower R values.

The 3×6 Tstud 72 construction includes a 3×2 all wood sections 74 which may be specially made or ripped from a 2×6 stud 22. Dimensions of this all wood section 74 may range from 1"-1½" (depth)×2"-3½" (width) and ideally are 1¼"×2½". A middle or sandwiched rigid foam insulation section 76 may range from 2"-3½" (depth)×2"-3½" and ideally are 2½"×2½" (width).

Wood is defined as any wood or lumber product and any wood derivative composite product. Whereby the definition of "wood derivative" is defined as a "New product that results from modifying an existing product, and which has different properties than those of the product it is derived from." Lumber, timber, wood, or wood derivative, includes any and all structural composite lumber products, such as laminated strand lumber, LSL, as it is commonly coined when ordering these products. This would include structural composite lumber (SCL), which includes laminated veneer lumber (LVL), parallel strand lumber (PSL), laminated strand lumber (LSL) and oriented strand lumber (OSL). Nanocellulose materials, such as cellulose nanocrystals (CNC), would be included in this group. These composite lumbers are of a family of engineered wood products created by layering dried and graded wood veneers, strands or flakes with moisture resistant adhesive into blocks of material known as billets, which are subsequently re-sawn into specified sizes. In SCL billets, the grain of each layer of veneer or flakes runs primarily in the same direction. The resulting products out-perform conventional lumber when either face- or edge-loaded. SCL is a solid, highly predictable, and uniform engineered wood product that is sawn to consistent sizes and is virtually free from warping and splitting.

The foam section 76 may be of injected expanded polyurethane, polystyrene or polyisocyanurate. The foam 76 may suitably made by mixing an isocyanate, such as methylene diphenyl diisocyanate (MDI) with a polyol blend, or other suitable rigid foam sheet or there equivalent. In fact, it is to be anticipated that rigid foams of yet even high R values are on the market now with more being created that are and will be suitable for use with the present invention. Polyurethane insulation has the highest thermal resistance (R-values) at a given thickness and lowest thermal conductivity.

Fire ratings of the Tstud 72 is a Class A or Class B with a R value of the unaged foam member 76 is anywhere from a 5 to as high as 8.5 and an aged R Value of approximately 20% less after the gases have vented from the foam 76.

A second all wood 3×2 section 78 is similar to the first wood section 74.

The foam may be glued to the wood sections 74 and 78. The Tstud 72 may also be nailed together with a 5½" nail 79 or screw or other mechanical fastener as described below in FIGS. 20-25. The R value of the Tstud alone may range from 15.62-18.74 depending on rigid insulation type.

After the insulation 68 is placed in the wall system 60, gypsum board, drywall or sheet rock 82 is nailed or screwed to the 3" faces of the Tstuds 72 finishing the inside of the building wall 60 except for paint or wall treatments.

Figure 9:
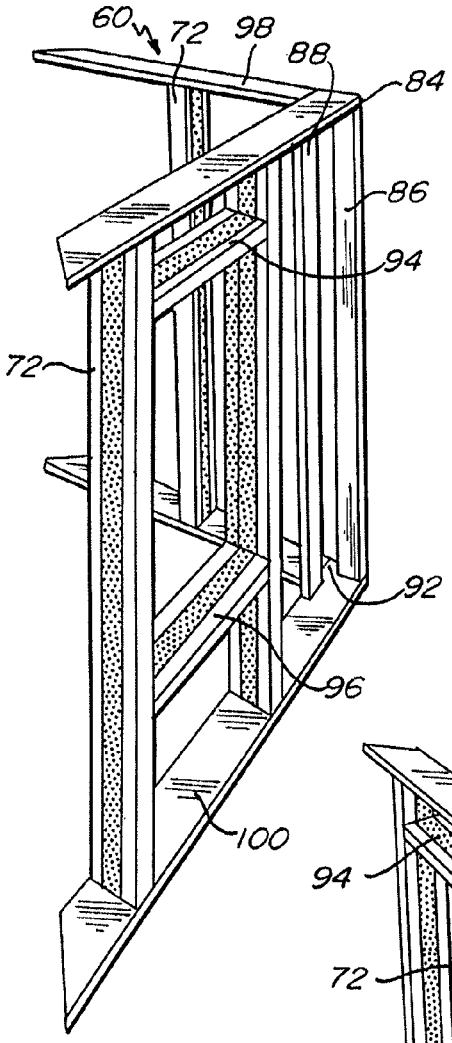
FIG. 9 is perspective view of a wall and corner segment construction of the present invention as shown in plan drawing of FIG. 6.
Figure 9A:
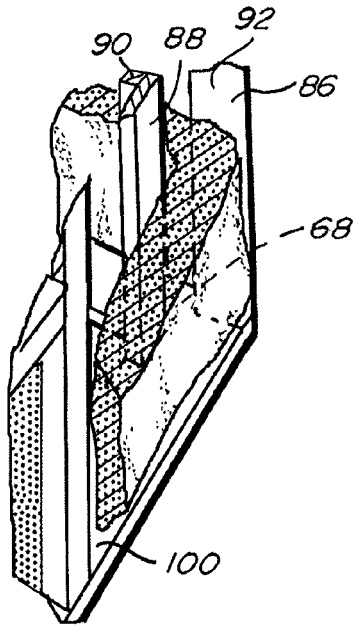
FIG. 9A is perspective view of a wall and corner segment construction of the present invention as shown in FIG. 9 with illustrative insulation wrapping through the thermal break area.
Figure 10:
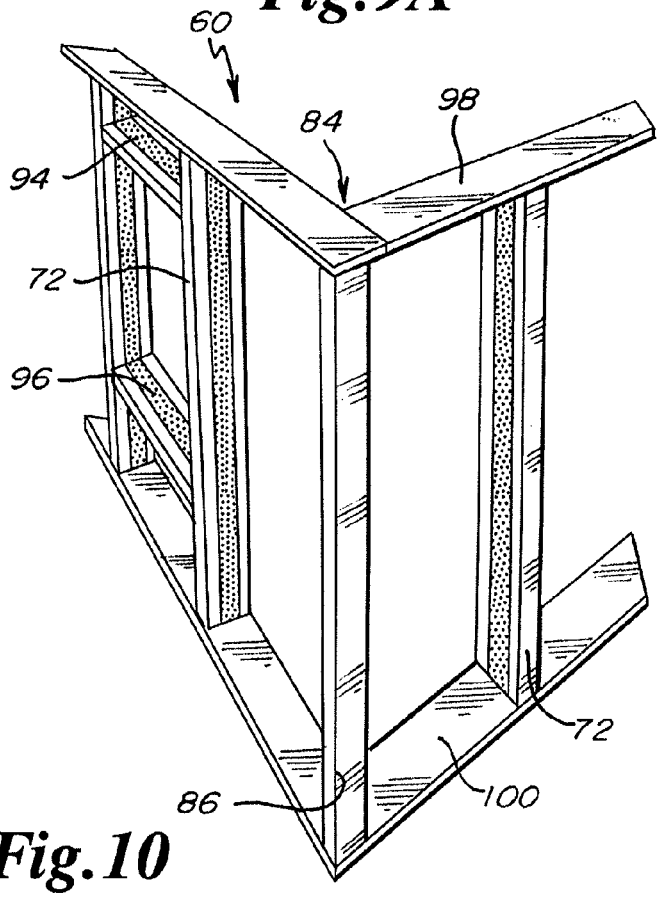
FIG. 10 is another perspective view of the wall and corner segment construction of the present invention as shown in plan drawing of FIG. 6 and FIG. 9.
Figure 11:
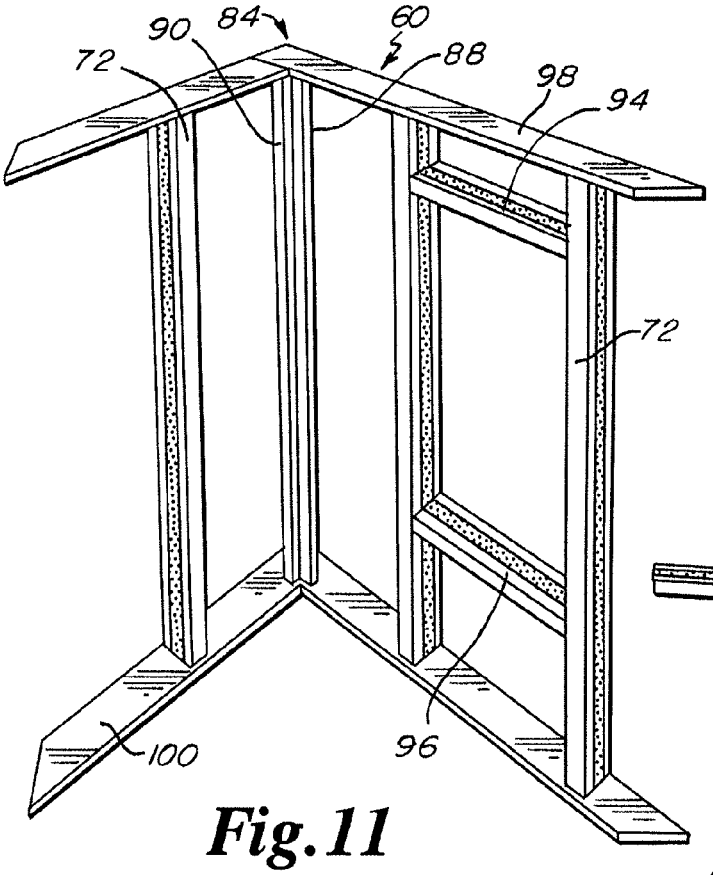
FIG. 11 is another perspective view of the wall and corner segment construction of the present invention as shown in plan drawing of FIG. 6 and FIGS. 9 and 10.

The Tstud corner 84 has an outer all wood 2×4 stud 86 and an inner all wood 2×4 stud 88 rotated 90 degrees from each other. An inside all wood 2×2 stud 90 is adjacent the inner stud 88 to complete the formation of the inside corner for nailing the gypsum board 82 thereto. By this arrangement, a thermal break 92 is formed in the Tstud corner 84 where fiberglass batt insulation 68 may be placed or spray-in insulation may be blown into the thermal break area 92. As shown in FIGS. 9 through 11, the thermal break wall system 60 is built in between 2×6 top and bottom plates 98 and 100 with vertical Tstuds 72 being nailed through these plates 98 and 100, 24" on center.

As seen in FIGS. 9 through 11, the 3×6 Tstuds 72 have good integral strength and they may be used as headers 94 and sills 96 without the need for cripple studs 34 used in standard construction 10 shown in FIGS. 1 through 5 and described above. More specifically, a single Tstud 72 may be used as a header for up to 4' 3" spans and two (or three) Tstuds 72 may be used for headers up to 8' 6" in width with only back nailing through the Tstuds.

Figure 12:
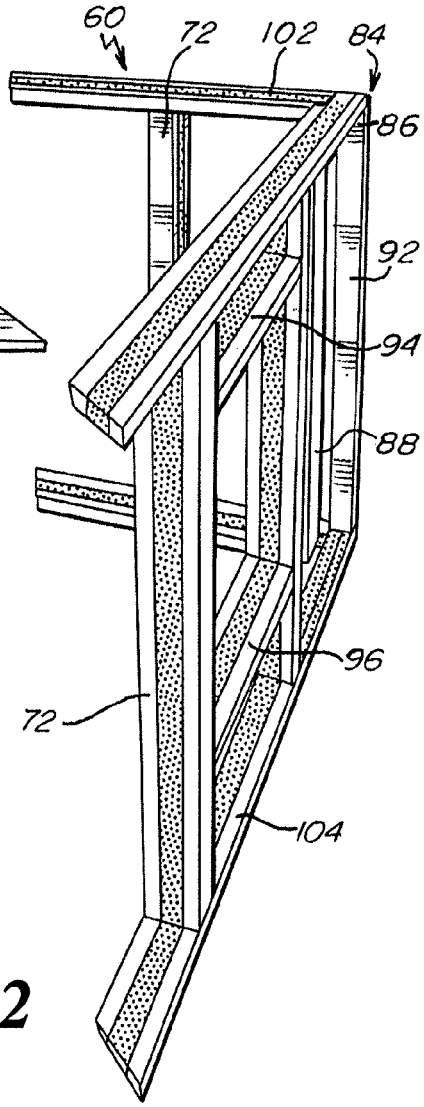
FIG. 12 is a perspective view of the wall and corner segment construction of the present invention as shown in plan drawing of FIG. 6 using the Tstud as top and bottom plates forming a complete thermal break between the inside and outside wall and corner surfaces.

FIG. 12 illustrates that the Tstuds 72 may also be used as top and bottom plates 102 and 104 thus completing the thermal break envelope for the entire building 60.

From the plan view (FIG. 6) the Tstud design and thermal break wall system 60 has greatly improved R values that are: through the 2×6 Tstuds 72 of 18.53; through the header 94 of 18.53; average through the pocket corner 84 of 24.52; and through the insulated wall portion of 25.28. A comparison with the standard building 10 and the Tstud building 60 are in the following Table 1:

R Values

TABLE 1

| Through | Standard Wooden Building | Through | Thermal Break Wall System |
|---|---|---|---|
| 2 × 6 Wall Stud | 9.16 | 3 × 6 T Stud | 18.53 |
| 2 × 6 Header | 15.285 | T Stud Header | 18.53 |
| Corner Average | 11.63 | T Stud Corner Average | 24.52 |
| Insulated Wall | 21.28 | Insulated Wall | 25.28 |
| Top/Bottom Plates | 9.16 | Top/Bottom Plates | 18.53 |

A comparison of labor cost savings with the standard building 10 and the Tstud building 60 are in the following Table 2:

Construction Cost Estimator

TABLE 2

| Spacing | Number of Studs | BF | Labor Costs | |
|---|---|---|---|---|
| Standard 16" on center | 109 | 7.95 | $0.42 | $363.95 |
| Thermal Break Stud 24" on center | 63 | 7.95 | $0.42 | $210.36 |
| Difference savings in labor | | | | $153.59 |
| | **Lineal Feet** | **BF** | **Labor Costs** | |
| Standard Double top plate | 256 | 0.6875 | $0.69 | $121.44 |
| Thermal Break Stud Single top plate | 128 | 0.6875 | $0.69 | $60.72 |
| Difference saving in labor | | | | $60.72 |
| Preferred method of framing a Tstud Energy Wall | | | | $214.31 Labor savings |

Figure 13:
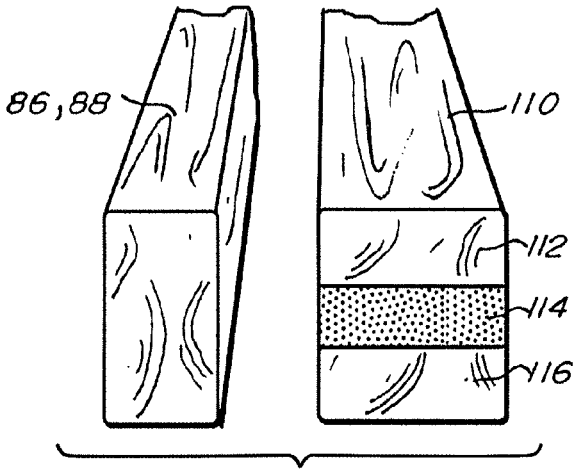
FIG. 13 is a perspective view of a standard dimensional 2×4 stud alongside of a 3×4 Tstud of the present invention.
Figure 14:
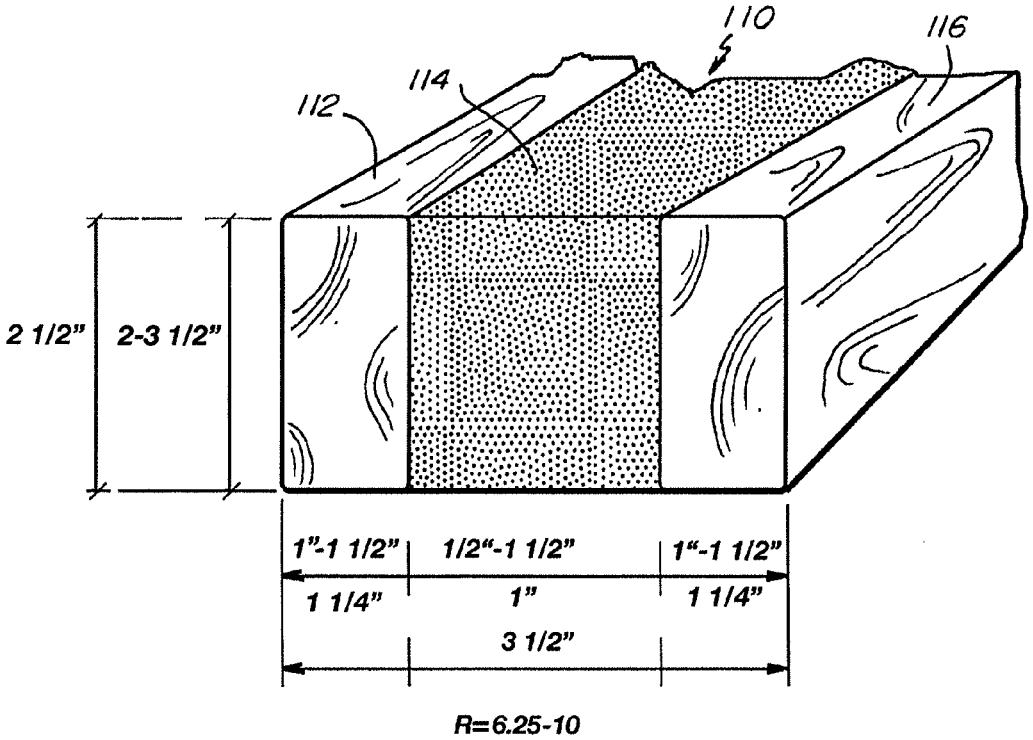
FIG. 14 is a dimensional view of the 3×4 Tstud of the present invention.

Labor Costs per Board Foot (BF) of Lumber, Exterior Wall
Model House 960 square feet and 128 lineal feet around perimeter, 8 foot tall wall
According to RS Means Construction Data 2009
Labor costs at $30 per hour Referring to FIGS. 13 and 14, a 3×4 thermal break Tstud 110 may be viewed as compared to a 2×4 stud 86 or 88. This 3×4 Tstud construction has applicability in southern geographic regions where 2×6 construction is not required by building codes.

The 3×4 Tstud 110 construction includes a 3×1 all wood section 112 which may be specially made. Dimensions of this all wood section 112 may range from 1"-1½" (depth)× 2"-3½" (width) and ideally 1¼"×2½". A middle or sandwiched rigid foam insulation section 114 may range from ½"-1½" (depth)×2"-3½" (width) and ideally 1"×2½". The foam section 114 may be of expanded polystyrene or polyisocyanurate. A second 3×1 section 116 is similar to the first wood section 112. The foam may be glued to the wood sections 112 and 114 and may also be nailed together with a 4" nail 79, screw or other mechanical fastener as described below in FIGS. 20-25. The R value of the Tstud may range from 6.25-10, depending on the insulation type, versus the R value of a 2×4 of 4.375.

Figure 15:
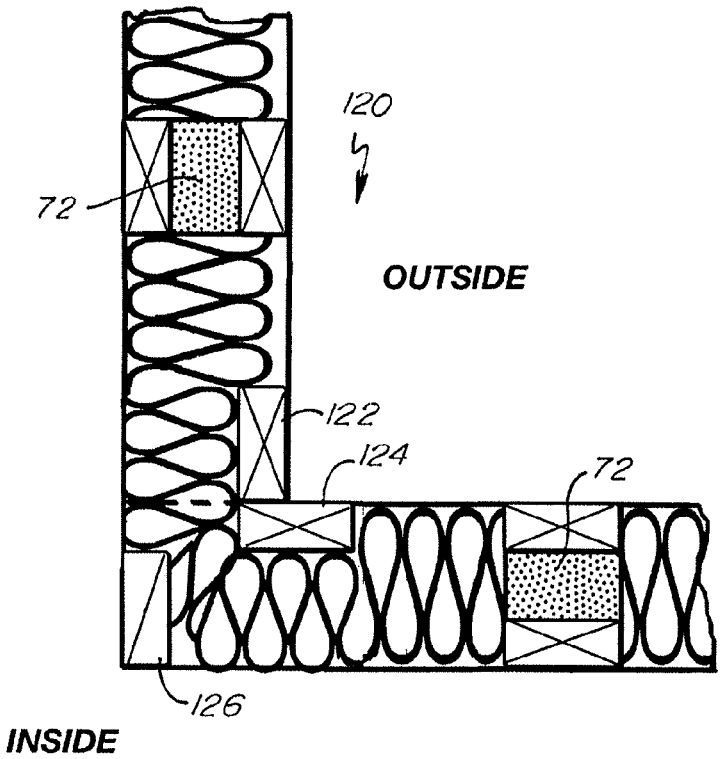
FIG. 15 is a top plan view of a second embodiment of the Tstud corner which is an inverted wall and corner segment of the present invention.

FIG. 15 shows a second embodiment of an inverted thermal break Tstud corner 120 wherein the corner juts into the interior of the building. The corner 120 is comprised of two outer 2×4 studs 122, 124 at a right angle to each other and an inner 2×4 stud 126 completing the interior corner for nailing gypsum board 82 thereto. A thermal break 73 is between the outer or exterior studs 122, 124 and inner or interior stud 126 for stuffing fiberglass batt insulation 68 therein. The average R value for this Tstud corner 120 is the same as for Tstud corner 84 shown in FIG. 6 and described above.

Figure 15A:
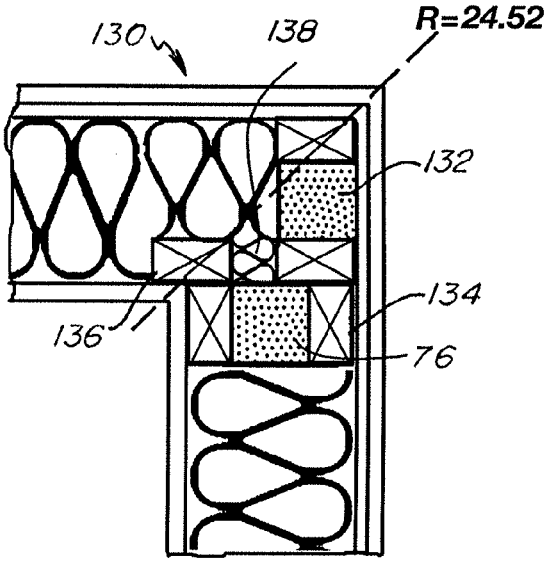
FIG. 15A is a top plan view of a third embodiment of a Tstud corner segment of the present invention.

Referring to FIG. 15A, a third embodiment of a Tstud corner 130 may be seen. The corner 120 has an outer 3×6 Tstud 132 which is the same as Tstud 72. An adjacent through-the-wall 3×6 Tstud 134 is 90 degrees from and touching outer 3×6 Tstud 132. An inner 2×4 wood stud 136 completes the inside corner for nailing gypsum board 82 thereto. The thermal break 138 is through space between the outer Tstud 132 and inner 2×4 wood stud 136 with batt insulation 68 therein and further through the rigid foam insulation 76 of the through-the-wall Tstud 134. The R value for this Tstud corner 130 is R=24.52.

Figure 15B:
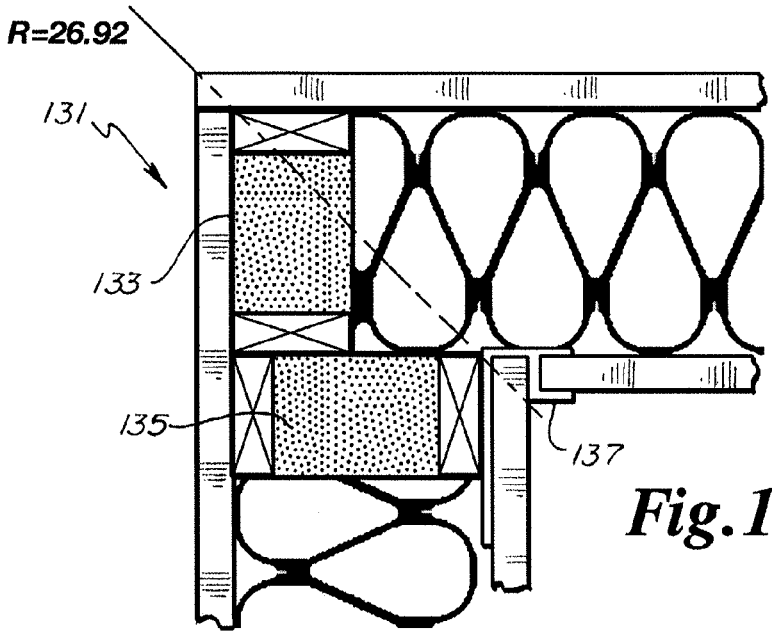
FIG. 15B is a top plan view of a fourth embodiment of a Tstud corner segment of the present invention.
Figure 16:
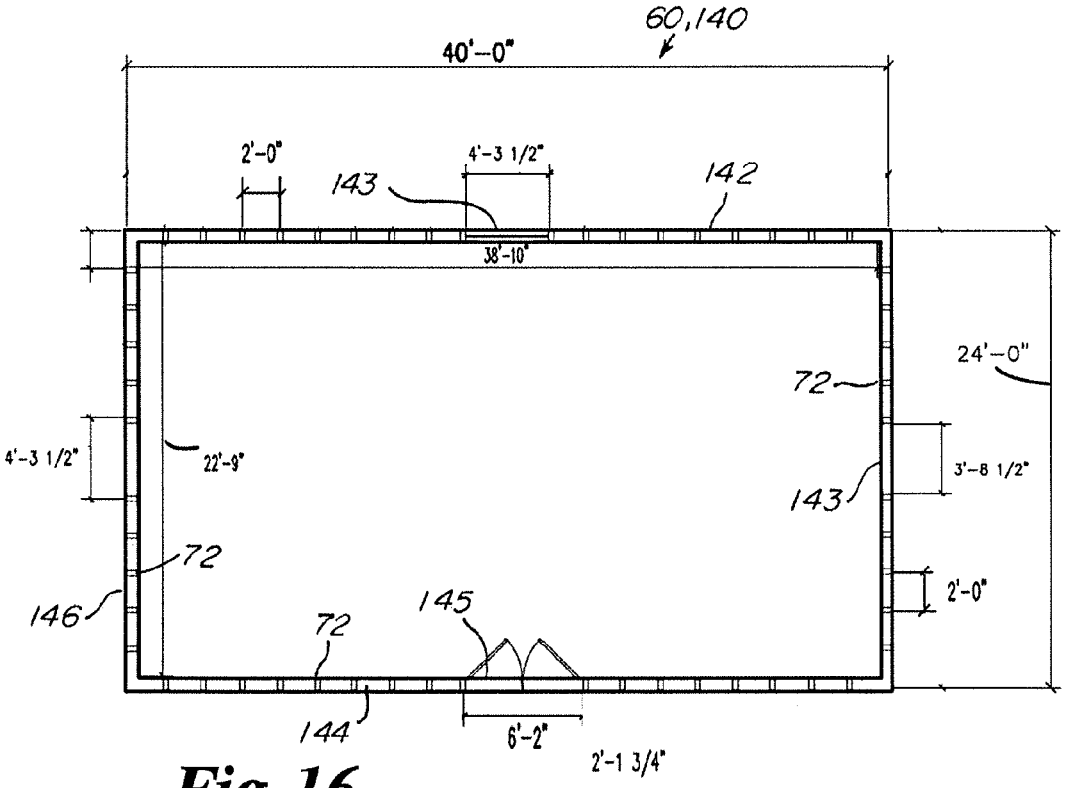
FIG. 16 is a plan view of a 960 square feet building constructed out of the Tstud design and framing system of the present invention.
Figure 17:
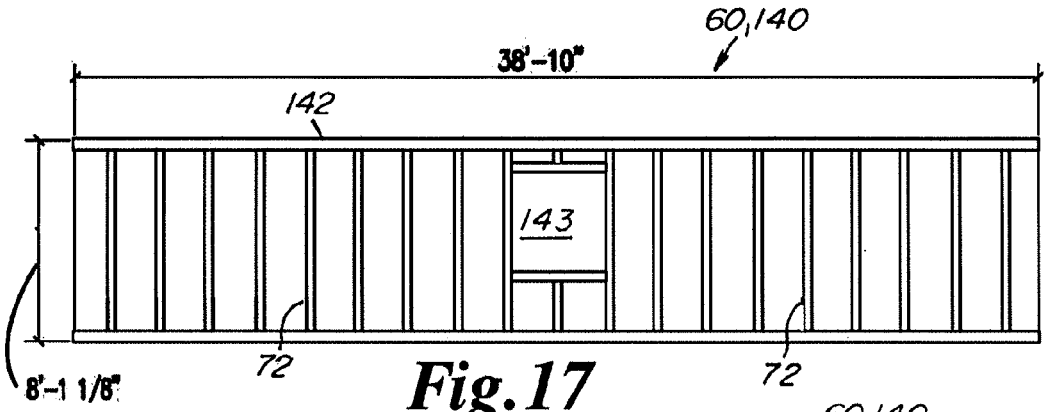
FIG. 17 is a rear wall elevational view of the building in FIG. 16 using the Tstud design and system.
Figure 18:
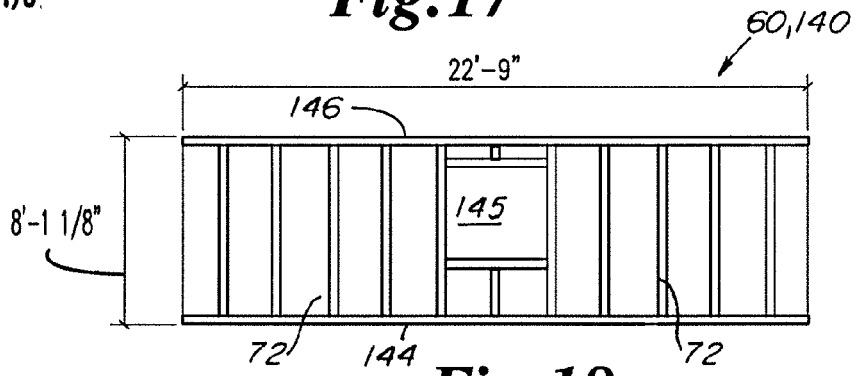
FIG. 18 is a left side elevational view of the building in FIG. 16 using the Tstud design and system, the right side being a mirror image thereof.
Figure 19:
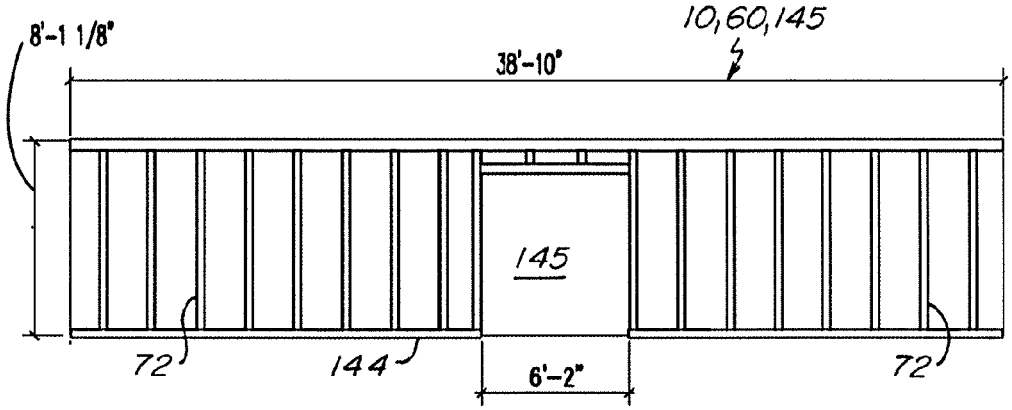
FIG. 19 is a front wall elevational view of the building in FIG. 16 using the Tsud design and system.

Referring to FIG. 15B, a fourth embodiment of a Tstud corner 131 may be seen. The corner 131 has an outer 3×6 Tstud 133 which is the same as Tstud 72. An adjacent through-the-wall 3×6 Tstud 135 is 90 degrees from and touching outer 3×6 Tstud 133. As currently required by California, a drywall clip 137 is secured to the through the wall Tstud 135 for supporting gypsum board 82. The R value for the Tstud corner 131 is 26.92.

Referring to FIGS. 16 through 19, a 960 square feet Tstud design and framed building 60, 140 may be seen and is directly comparable to the standard 960 square feet building 10 of FIGS. 1 through 5 as described above. The Tstud building 140 has a window back wall 142 with window 143, a door front wall 143 with a door 145 and mirror image side walls 146. The vertical Tstuds 72 are 24" on center. This Tstud construction uses 63 vertical studs.

Cripple studs 34 may be used along windows 143, doors 145 and headers 94. This Tstud building 140 saves 32 vertical studs over the standard building 10 because the Tstuds are 24" on center and efficiency is increased with more space for insulation 18. When Tstuds 72 are used for top and bottom plates 102, 104, the Tstud building 140 also has a complete thermal break around its perimeter without the need for expensive rigid foam being nailed to the outer perimeter of the building 140.

Figure 20:
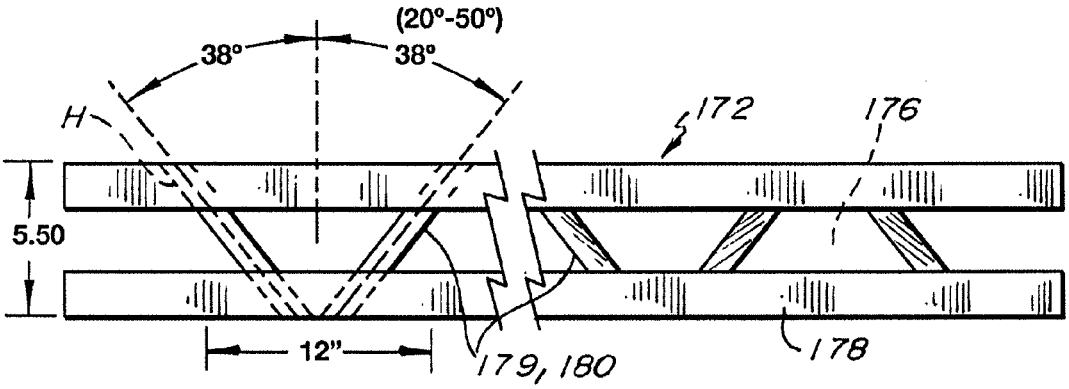
FIG. 20 is a side elevational view of the Tstud broken away showing mechanical fasteners of wood dowels positioned at an angle between the non-dimensional lumber and through the rigid foam.
Figure 21:
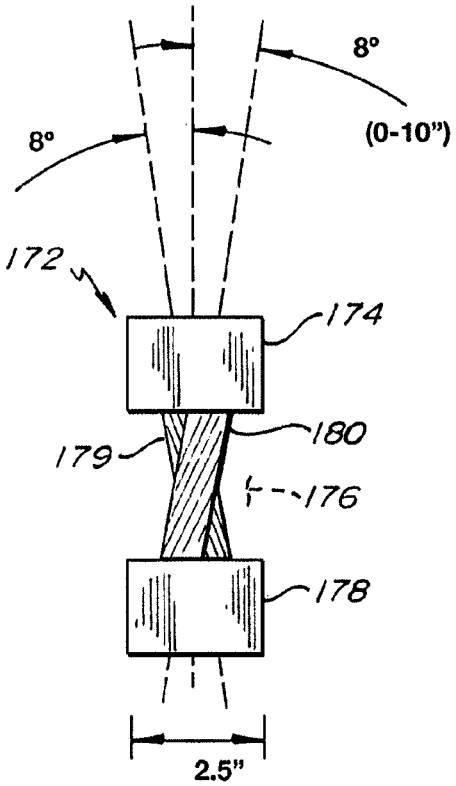
FIG. 21 is an end view of the Tstud showing the mechanical fasteners of wood dowels positioned in a second angle between the non-dimensional lumber and through the rigid foam.
Figure 22:
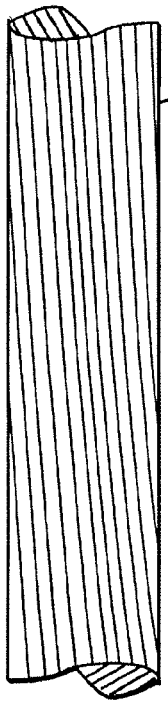
FIG. 22 is an elevational view of the wood dowel mechanical fastener showing exterior grooves which hold an adhesive before the dowel is inserted into the Tstud.

Referring to FIGS. 20 through 24, another embodiment of the Tstud 172 may be appreciated. Tstud 172 is dimensionally the same as Tstud 72 shown in FIGS. 7 and 8 or Tstud 110 shown in FIGS. 13 and 14. Tstud 172 has a non-dimensional first wood section 174, a middle foam section 176 and a second non-dimensional wood section 178. Wood sections 174 and 178 may be held in the desired spacial relationship suitably with a jig (not shown). By this assembly method, the finished Tstud 172 is perfectly straight to correct for warping, twisting and cupping thereby assuring less wood waste and a perfectly straight end product virtually every time. Angled holes H approximately one foot apart and ½-1½" in diameter (ideally 11/16" for 3×6 version and ½" for the 3×4 version). Holes H are drilled or bored through wood sections 174 and 178 at a side face angle to vertical of range of 20°-50° and ideally 38° (FIG. 20). From an end view (FIG. 21), the holes H are canted in a range of 0°-10° and ideally 8°. Angled holes H are for receiving glued mechanical fasteners 179 described below.

Mechanical fasters 179 are suitably wood dowels 180 ideally 11/16" to match holes H. For the 3×4 Tstud 110 the holes H are ideally ½". The dowels are run through an abrader device to create a helical outer grooved surface 182 which aids in retaining glue 190 on the outer surface 182 of dowels 180. Next, wood glue is suitably then coated on the inside surfaces of the angled holes H. The dowels 180 are then pounded into and through holes H after which sawing, sanding or grinding will make the dowels 180 flush with the wood section 174 and 178.

Suitable wood glues might be polymethylene polyphenyl isocyanate or penta-NA diethylenetriamine pentaacetate obtainable from Ashland of Columbus, Ohio under the trademark Isoset™.

By this new arrange of Tstud 172, improve strength shown below in Table 3:

Comparative Stud Strength

TABLE 3

| Reference Design Values for Tstud 5½" depth | Tstud | Tstud | 2 × 6 SPF | 2 × 4 SPF |
|---|---|---|---|---|
| Lumber Grade | 1650 f-1.5E SPF | No. 2 SPF | Stud | Stud |
| Bending, Fb | 889 lb-in2 | 889 lb-ft | 425 lb-ft | 189 lb-ft |
| Compression Parallel to Grain, FC | 1,700 psi | 1,150 psi | 725 psi | 725 psi |
| Tension Parallel to Grain, Ft | 1,020 psi | 450 psi | 350 psi | 350 psi |
| Compression Perpendicular to Grain, Fc ⊥ | 425 psi | 425 psi | 425 psi | 425 psi |
| Shear Force, V | 320 lbs | 320 lbs | 743 lbs | 473 lbs |
| Bending Stiffness, E1 | 30,500,000 lb-in$^2$ | 30,300,000 lb-in$^2$ | 24,956,250 lb-in$^2$ | 6,431,2500 lb-in$^2$ |
| Bending Stiffness for Beam and Column Stability, $E_1$ min | 15,000,000 lb-in$^2$ | 14,900,000 lb-in$^2$ | 9,150,625 lb-in$^2$ | 2,358,125 lb-in$^2$ |

Figure 25:
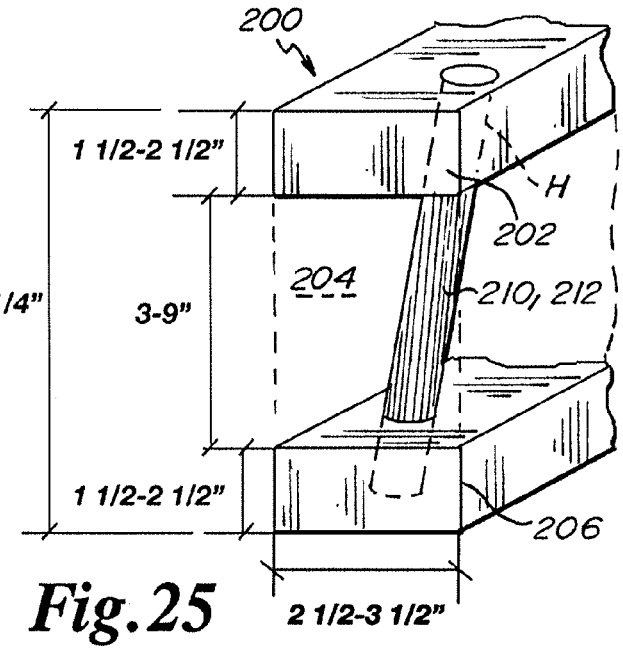
FIG. 25 is a perspective end view of a larger sized Tstud which may be used for wall studs, roof members and floor members.
Figure 23:
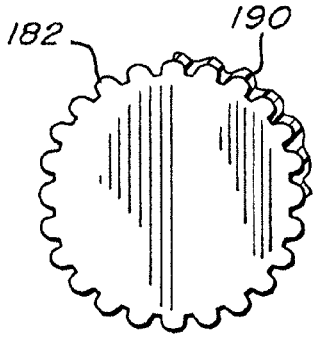
FIG. 23 is an end view of the wood dowel mechanical fastener.
Figure 24:
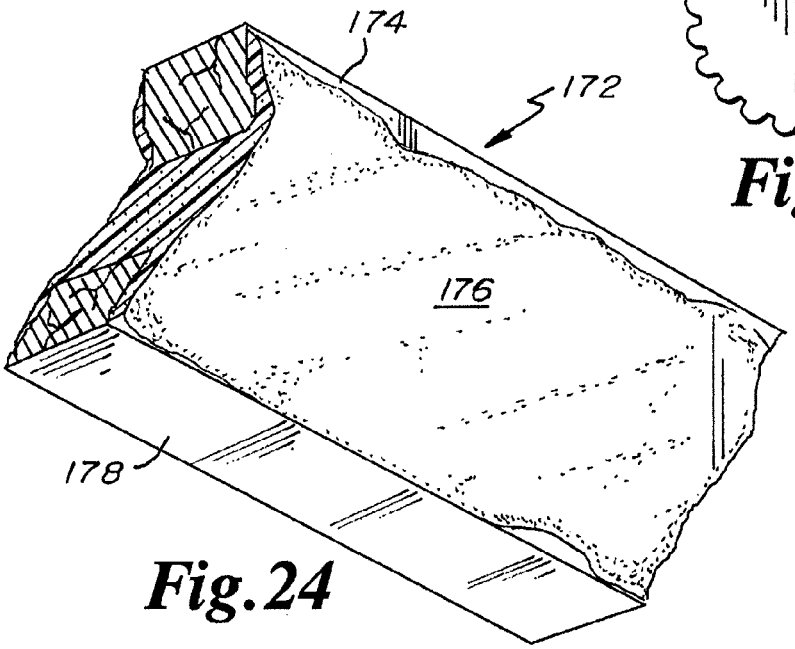
FIG. 24 is a perspective view of the Tstud with the set rigid foam covering the side faces of the Tstud.

(As tested and reported by Qualtim, Inc. Madison, WI)
For S1 psi = 0.00689 Mpa, 1 lbs = 4.45 N, 1" = 25.4 mm
SPF = spruce-pine-fir Referring to FIG. 25, a larger sized Tstud 200 may be seen which might be used for floor members, roof members or wall studs suitably of sizes 3"×8", 3"×10", 3×12" or 4"×8", 4×10", or 4×12". The range of dimensions of Tstud 200 are shown in FIG. 25.

More specifically, the Tstud 200 construction includes all wood sections 202 and 206 which may be specially made. Dimensions of these all wood sections 202 and 206 may range from 1½"-2½" (depth)×2½"-3½" (width). A middle or sandwiched rigid foam insulation section 204 may range from 3"-9" (depth)×2½"-3½" (width). Thus, the overall depth of Tstud 200 may range from 5½" to 11½".

Tstud 200 is similar in overall construction as Tstuds 72, 110 and 172. Tstud 200 has a non-dimensional wood section 202 a middle foam section 204 and a second non-dimensional wood section 206. Wood sections 202 and 204 may be held in the desired spacial relationship suitably with a jig (not shown). By this assembly method, the finished Tstud 200 is perfectly straight to correct for warping, twisting and cupping thereby assuring less wood waste and a perfectly straight end product virtually every time. Angled holes H approximately one foot apart and ½-1½" in diameter. Holes H are drilled or bored through wood sections 202 and 206 at an angle to vertical of range of 20°-50° and ideally 25°. From an end view (FIG. 21), the holes H are canted in a range of 0°-10° and ideally 5°. Angled holes H are for receiving glued mechanical fasteners 210.

Mechanical fasters 210 are suitably wood dowels 212 approximately 11/16-1½" to match holes H. The dowels 212 are run through an abrader device to create a helical outer grooved surface 182 which aids in retaining glue 190 on the outer surface 182 of dowels 212 (as shown in FIGS. 20-23). Next, wood glue 190 is suitably then coated on the inside surfaces of the angled holes H. The dowels 212 are then pounded into and through holes H after which sawing, sanding or grinding will make the dowels 212 flush with the wood section 202 and 204.

Suitable wood glues might be polymethylene polyphenyl isocyanate or penta-NA diethylenetriamine pentaacetate obtainable from Ashland of Columbus, Ohio under the trademark Isoset™.

The above embodiments are for illustrative purposes and the scope of this invention is described in the appended claims below.

What is claimed:

1. A 3×6 inch non-dimensional thermal break wood and rigid insulation stud, the 3×6 thermal stud comprising:

(a.) two non-dimensional lumber 3×2 inch sections each having dimensions which range from 1-1½ inches (depth) by 2-3½ inches (width) excluding 2×4 dimensional lumber with a thermal break section of rigid foam insulation positioned therebetween whose dimensions range from 2-3½ inches (depth) by 2-3½ inches (width);

(b.) non-metallic mechanical fasteners securing the lumber sections and the thermal break insulation section together; and (c.) wherein the 3×6 thermal stud is configured for placement in a wall to be at least one of (i) top and bottom plates, (ii) vertical wall studs secured between the plates, and (iii) headers, sills and cripples of a framing system for residential and light commercial buildings.

2. The 3×6 inch non-metallic dimensional thermal break wood and rigid insulation stud of claim 1, wherein the non-mechanical fasteners comprise glued-in wood dowels.

3. The 3×6 inch non-dimensional thermal break wood and rigid insulation stud of claim 2, wherein the wood dowels are angled from vertical length of the stud in alternating fashion between 20° and 50°.

4. The 3×6 inch non-dimensional thermal break wood and rigid insulation stud of claim 2, wherein the wood dowels are angled from vertical width of the stud in alternating fashion between 0° and 10°.

5. The 3×6 inch non-dimensional thermal break wood and rigid insulation stud of claim 2, wherein the wood dowels are ½" to 1½" in diameter.

6. The 3×6 inch non-dimensional thermal break wood and rigid insulation stud of claim 2, wherein the wood dowels have a roughened outer surface.

7. A 3×4 inch non-dimensional thermal break wood and rigid insulation stud, comprising:

(a.) two non-dimensional lumber 3×1 inch sections each having dimensions which range from 1-1½ inches (depth) by 2-3½ inches (width) excluding 2×4 dimensional lumber and a middle rigid foam insulation section positioned therebetween whose dimensions range from ½-1½ inches (depth) by 2-3½ inches (width);

(b.) non-metallic mechanical fasteners securing the lumber sections and the middle rigid foam insulation section together; and (c.) wherein the 3×4 thermal stud is configured for placement in a wall to be at least one of (i) top and bottom plates, (ii) vertical wall studs secured between the plates, and (iii) headers, sills and cripples of a framing system for residential and light commercial buildings.

8. The 3×4 inch non-dimensional thermal break wood and rigid insulation stud of claim 7, wherein the non-metallic mechanical fasteners comprise glued-in wood dowels.

9. The 3×4 inch non-dimensional thermal break wood and rigid insulation stud of claim 8, wherein the wood dowels are angled from vertical length of the stud in alternating fashion between 20° and 50°.

10. The 3×4 inch non-dimensional thermal break wood and rigid insulation stud of claim 8, wherein the wood dowels are angled from vertical width of the stud in alternating fashion between 0° and 10°.

11. The 3×4 inch non-dimensional thermal break wood and rigid insulation stud of claim 8, wherein the wood dowels are ½" to 1½" in diameter.

12. A non-dimensional thermal break wood and rigid insulation stud for floor members, roof members and wall studs, the thermal break stud comprising:

(a.) two non-dimensional lumber sections each having dimensions which range from 1-1½ inches (depth) by 2½-3½ inches (width) with a thermal break section of rigid foam insulation positioned therebetween whose dimensions range from 3-9 inches (depth) by 2½-3½ inches (width);

(b.) non-metallic mechanical fasteners securing the lumber sections and the thermal break insulation section together; and (c.) wherein the thermal break stud is devoid of dimensional lumber and is configured for placement to be at least one of (i) the floor members, (ii) vertical wall studs, and (iii) the roof members of a framing system for residential and light commercial buildings.

13. The non-dimensional thermal break wood and rigid insulation stud of claim 12, wherein the non-metallic mechanical fasteners comprise glued-in wood dowels.

14. The non-dimensional thermal break wood and rigid insulation stud of claim 13, wherein the wood dowels are angled from vertical length of the stud in alternating fashion between 20° and 50°.

15. The non-dimensional thermal break wood and rigid insulation stud of claim 13, wherein the wood dowels are angled from vertical width of the stud in alternating fashion between 0° and 10°.

16. The non-dimensional thermal break wood and rigid insulation stud of claim 13, wherein the wood dowels are ½" to 1½" in diameter.

17. A non-dimensional thermal break wood and rigid insulation stud for floor members, roof members and wall studs, the thermal break stud comprising:

(a.) two non-dimensional lumber sections with a thermal break section of rigid foam insulation positioned therebetween;

(b.) non-metallic mechanical fasteners comprising glued-in wood dowels securing the lumber sections and the thermal break insulation section together; and (c.) wherein the thermal break stud is devoid of dimensional lumber and is configured for placement to be at least one of (i) top and bottom plates, (ii) vertical wall studs secured between the plates, (iii) headers, sills and cripples, (iv) the floor members, (v) vertical wall studs, and (vi) the roof members of a framing system for residential and light commercial buildings.

18. The non-dimensional thermal break wood and rigid insulation stud of claim 17, wherein the wood dowels are angled from vertical length of the stud in alternating fashion between 20° and 50°.

19. The non-dimensional thermal break wood and rigid insulation stud of claim 17, wherein the wood dowels are angled from vertical width of the stud in alternating fashion between 0° and 10°.

20. The non-dimensional thermal break wood and rigid insulation stud of claim 17, wherein the wood dowels are ½" to 1½" in diameter.

21. The non-dimensional thermal break wood and rigid insulation stud of claim 17, wherein the two non-dimensional lumber sections are 3×2 inch sections each having dimensions which range from 1-1½ inches (depth) by 2-3½ inches (width) excluding 2×4 dimensional lumber with the thermal break section of rigid foam insulation having dimensions which range from 2-3½ inches (depth) by 2-3½ inches (width).

22. The non-dimensional thermal break wood and rigid insulation stud of claim 17, wherein the two non-dimensional lumber sections are 3×1 inch sections each having dimensions which range from 1-1½ inches (depth) by 2-3½ inches (width) excluding 2×4 dimensional lumber and the thermal break section of rigid foam insulation section having dimensions which range from ½-1½ inches (depth) by 2-3½ inches (width).

23. The non-dimensional thermal break wood and rigid insulation stud of claim 17, wherein the two non-dimensional lumber sections each having dimensions which range from 1-2½ inches (depth) by 2½-3½ inches (width) excluding 2×4 dimensional lumber and the thermal break section of rigid foam insulation section having dimensions which range from 3-9 inches (depth) by 2½-3½ inches (width).

* * * * *